United States Patent [19]

Landers

[11] Patent Number: 4,779,389

[45] Date of Patent: Oct. 25, 1988

[54] METHOD AND APPARATUS FOR INSITU REINFORCEMENT, REPAIR AND SAFETY ENHANCEMENT OF WOODEN POLES

[76] Inventor: Phillip G. Landers, 518 Santander Dr., San Ramon, Calif. 94583

[21] Appl. No.: 20,665

[22] Filed: Mar. 2, 1987

[51] Int. Cl.[4] ..... E02D 5/60

[52] U.S. Cl. ..... 52/169.13; 52/170; 52/742; 52/514; 52/309.7; 405/216

[58] Field of Search ..... 405/216; 52/725, 309.7, 52/742, 98, 170, 169.13, 99, 309.8, 514

[56] References Cited

U.S. PATENT DOCUMENTS

| | | | |
|---|---|---|---|
| 968,798 | 8/1910 | Proper . | |
| 1,339,535 | 5/1920 | White | 405/216 |
| 1,947,413 | 2/1934 | Hay . | |
| 2,385,869 | 10/1945 | Lane . | |
| 2,412,185 | 12/1946 | Weber . | |
| 2,897,553 | 8/1959 | Gorrow | 405/216 |
| 3,370,998 | 2/1968 | Wiswell | 405/216 |
| 3,403,520 | 10/1968 | Goodman | 52/169.13 |
| 3,552,698 | 1/1971 | Kinney | 403/2 |
| 3,553,970 | 1/1971 | Wiswell | 405/216 |
| 3,564,859 | 2/1971 | Goodman | 52/170 |
| 3,586,019 | 6/1971 | Thomas | 403/2 |
| 3,611,736 | 10/1971 | Goodman | 52/169.13 |
| 3,637,244 | 1/1972 | Strizki | 52/98 |
| 3,703,812 | 11/1972 | Newton . | |
| 3,708,146 | 1/1973 | Lamberton . | |
| 3,736,759 | 6/1973 | Blose | 405/216 |
| 3,939,665 | 2/1976 | Gosse et al. . | |
| 3,967,906 | 7/1976 | Strizki | 52/98 |
| 4,019,301 | 4/1977 | Fox | 52/725 |
| 4,068,483 | 1/1978 | Papworth | 405/216 |
| 4,244,156 | 1/1981 | Watts, Jr. . | |
| 4,306,821 | 12/1981 | Moore | 405/216 |
| 4,439,070 | 3/1984 | Dimmick | 52/725 |
| 4,603,520 | 8/1986 | Deike | 52/98 |
| 4,644,715 | 2/1987 | Burell | 52/170 |
| 4,644,722 | 2/1987 | Phillips | 52/170 |

FOREIGN PATENT DOCUMENTS

| | | | |
|---|---|---|---|
| 1494072 | 12/1977 | United Kingdom | 405/216 |

*Primary Examiner*—John E. Murtagh

*Attorney, Agent, or Firm*—Glen R. Grunewald; Thomas R. Lampe

[57] ABSTRACT

A method and apparatus for insitu reinforcement of a section of a wooden pole at a position below the groundline is disclosed. The method includes the steps of forming a cavity around the pole, mounting an elongated sleeve around the pole to define an annular space with the pole, and filling the space with a reinforcing material. The improved portion of the method includes supporting the sleeve above the groundline while mounting the same around the pole and securing the lower end against radial expansion, lowering the sleeve until it extends over the section to be reinforced, and filling the sleeve with a bonding agent, such as a foaming epoxy resin system, which bonds the sleeve to the pole over the length of the section to be reinforced. Preferably the upper end of the sleeve is contracted and sealed against the pole. A sleeve assembly suitable for use in practicing the method, and a sleeve assembly including a horizontally extending shear plane structure to enhance the safety of poles next to highways are disclosed.

16 Claims, 4 Drawing Sheets

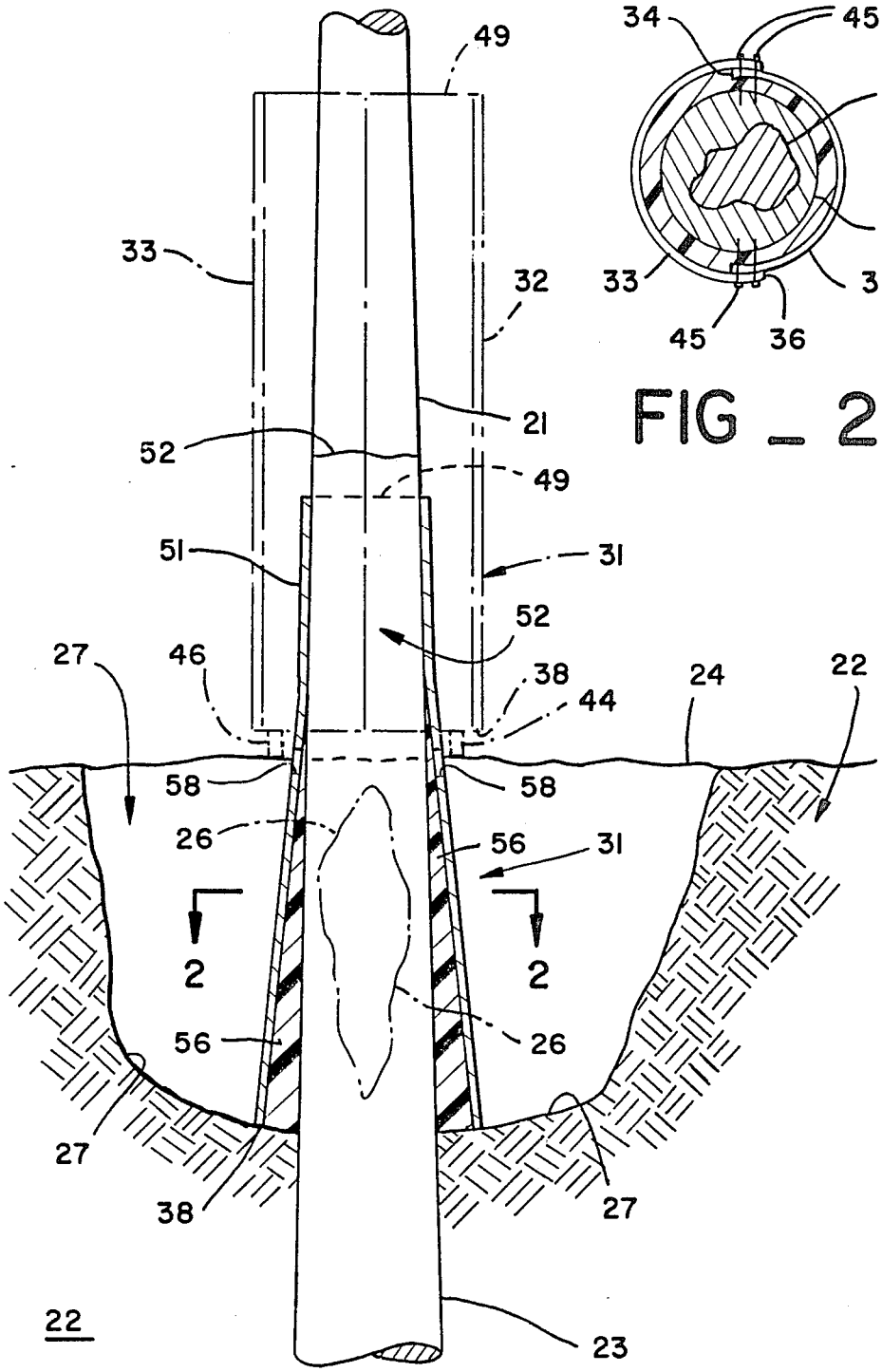
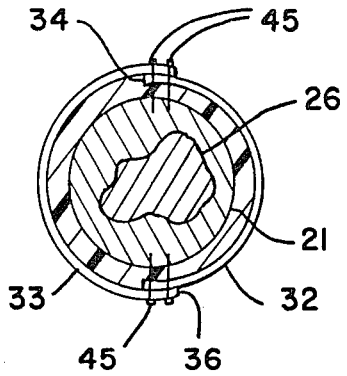
FIG _ 2
FIG _ 1

METHOD AND APPARATUS FOR INSITU REINFORCEMENT, REPAIR AND SAFETY ENHANCEMENT OF WOODEN POLES

TECHNICAL FIELD

The present invention relates, in general, to the repair, replacement and safety enhancement of utility poles of various kinds, and more particularly, relates to the insitu reinforcement or repair of decaying wooden utility poles and the insitu provision of a shear plane in wooden utility poles.

BACKGROUND ART

The use of wooden poles in various utility systems throughout the world is extremely widespread. Such poles are usually treated with a fumigant and/or preservative before they are placed in the ground, but in most environments, the presence of moisture and pests slowly results in deterioration and decay of the pole proximate and below the groundline. Accordingly, currently there are literally millions and millions of wooden utility poles that are in various stages of decay and deterioration which will require their repair, reinforcement or replacement at significant expense.

While the problem of utility pole decay is greatest in connection with wooden poles, even metal poles and plastic coated metal poles can experience corrosion. In the broadest aspect, therefore, the method and apparatus of the present invention are useful in the reinforcement and/or repair of a section of pole, whether that pole is wooden, metallic or a composite pole.

The decay and rotting which occurs in wooden poles is usually confined to a depth of about two to three feet below the groundline. In most soils, rotting of a wooden pole below three feet will not occur because the conditions around the pole become anaerobic, i.e., they lack sufficient oxygen to support active rotting and decay. A utility pole will typically be buried to a depth of at least 10 percent of its length. A pole having a height in the range of about 25 feet to about 100 feet, for example, will be buried to a depth of about 5½ feet to about 12 feet. It is possible, therefore, to repair a defective pole insitu if the pole can be reinforced from a position below the decayed section to a position above the decayed section.

While not entirely analogous, there are similar replacement problems faced in connection with underwater wooden pilings. The problems encountered in connection with repair of pilings insitu in a water environment (particularly in tidal installations) can be somewhat easier and are considerably different than the insitu repair of utility poles buried in the ground.

Considerable effort has been directed toward the repair of wooden and concrete pilings in a water environment. Typical of the repair apparatus and methods are the systems disclosed in U.S. Pat. Nos. 1,947,413; 2,385,869; 2,412,185; 3,708,146; 3,939,665; and 4,244,156. Common to these patented systems is the use of a sleeve assembly which is mounted to the pole or piling from a side thereof and extends along the length to be reinforced. Most usually the sleeve assembly is circumferentially spaced from the pole and acts as a mold into which concrete is poured. In some of these systems the shell or sleeve is removed, while in others it remains on the pole. While the concrete reinforces the pole, the sleeve assembly does not contribute to the reinforcement, since it is not bonded to the concrete. In U.S. Pat. No. 4,244,156, a foamed adhesive, such as polyurethane, is used to secure a protective plastic shell to a piling or pole, but the assembly is used to resist abrasion, not to reinforce the strength of the piling.

U.S. Pat. No. 968,798 discloses a similar shell-based pole repair system for the insitu repair of wooden, utility poles while buried in the ground. This patent discloses the use of a segmented shell that is positioned around the pole with a portion of the shell extending above the ground and a portion extending into a cavity around the pole below the ground. Reinforcing material is placed inside the shell, and a "plastic" material is poured into the shell and allowed to cure. Once cured, the shell is removed to leave the reinforced material around the pole. The plastic material in U.S. Pat. No. 968,798 is not specified, but undoubtedly is a material such as concrete, which does not need to be contained to be effectively molded and cured and which will easily release from the molding shell. The system does not employ the strength of the shell in effecting reinforcement of the pole.

Other more peripheral pole protection and/or repair systems are disclosed in U.S. Pat. Nos. 3,564,859 and 3,703,812.

A further prior art approach which has been employed is to mount a tapered or frusto-conical steel collar or sleeve around the pole with the small end supported on the ground and to rotate the collar down into the ground around the pole. The lower edge or small diameter of the steel collar has a jaw or blade construction which enables the collar to be rotated or screwed down into the ground. This system, however, requires a relatively heavy and expensive collar driving equipment, and there are many utility poles which are located at sites which will not permit the use of such equipment. Such collars are screwed into the ground to a depth of about three to four feet, and the upwardly diverging tapered cone can then be filled with a cement aggregate or a foam. When a foam is employed, the upper end of the cone is closed by a cap structure. The combined steel sleeve and aggregate are left in the ground around of the pole.

A further alternative, of course, has been the complete replacement of the pole. While the pole itself is not expensive to replace, the labor in connection with removal of the utility lines from the old pole and mounting of the same to the new pole is substantial.

Wooden utility poles conventionally have been installed proximate roads and highways. Such installations pose a serious hazard to motorists in the event that they should lose control of their automobiles. As highways are modernized and improved, utility poles are typically moved farther from the highways, but there are many situations in which such repositioning of utility poles is not possible or economically very burdensome.

One approach which can be taken to enhance the safety of utility poles proximate roadways is to provide poles which include a weakened or shear plane. The provision of a shear plane will result in transverse shearing of the pole by a relatively low force when the pole is struck by an automobile. In new metal pole installations this has been accomplished by mounting the pole to a base structure by a plurality of shear bolts. The bolts provide sufficient axial strenth to support the pole under all conditions except a lateral impact, for example, by an automobile.

The provision of a shear plane in wooden utility poles, however, is not as easily accomplished, particularly if the pole already is installed. One approach has been to drill holes in the sides of the pole to provide a weakened plane. The result, however, often has been to weaken the overall pole strength too much, and it is very difficult to control or predict the force which will shear the pole when using this technique.

Prior art utility pole repair, reinforcement and shear plane safety enhancement systems, therefore, have been found to have several disadvantages. The method and apparatus of the present inention seek to overcome these disadvantages and to provide an improved insitu pole repair, reinforcement and safety enhancement system which is particularly well suited for use with ground-supported, wooden utility poles.

More particularly, it is an object of the present invention to provide a method and apparatus for insitu repair of wooden utility poles which is relatively inexpensive and simple to use and yet provides a high strength reinforcement around a section of pole below the groundline.

Another object of the present invention is to provide a method and apparatus for insitu reinforcement of poles which does not require special complex equipment and can be employed by relatively unskilled personnel.

A further object of the present invention is to provide a method for insitu reinforcement of wooden utility poles which is compatible with conventional wooden pole fumigating procedures.

Another object of the present invention is to provide a method for reinforcement of wooden utility poles which is suitable for use with poles in virtually all terrains and environments.

Another object of the present invention is to provide a method and apparatus which enables the provision of a shear plane in a wooden utility pole.

A further object of the present invention is to provide a method and apparatus which is well suited to enhance wooden utility pole safety by the insitu reinforcement and provision of a shear plane in the pole.

A further object of the present invention is to provide a sleeve assembly which can be used by relatively unskilled personnel to rapidly and inexpensively form a reinforcement across a section of pole beneath the groundline while the pole remains supported by the ground.

Still another object of the present invention is to provide a method and apparatus for insitu reinforcement, repair and safety enhancement of a wooden utility pole which is a high-strength, durable and low-cost system.

The utility pole reinforcement and repair system of the present invention has other objects and features of advantage which will become apparent from and are set forth in more detail in the following description of the Best Mode Of Carrying Out The Invention and the accompanying drawings.

DISCLOSURE OF INVENTION

The method of insitu reinforcement of the present invention includes the steps of: forming an annular cavity in the ground around the pole to a depth exposing the section, mounting an elongated sleeve around the pole from a side of the pole with the sleeve positioned in radially spaced relation to the pole and filling the space between the sleeve and pole with a reinforcing material.

The improvement in the insitu reinforcement method of the present invention comprises, briefly, during the mounting step, supporting said sleeve with the majority of the length thereof above the groundline while loosely coupling the sleeve around the pole and circumferentially securing the lower end of the sleeve against radial expansion; after the supporting step, lowering the sleeve down the pole until the sleeve extends over the section of the pole to be reinforced, circumferentially securing the upper end of the sleeve against radial expansion; and during the filling step, filling the space below the upper end with a foaming bonding agent selected to rigidly bond the sleeve to the pole.

The apparatus for insitu reinforcement of a wooden utility pole includes a sleeve assembly mounted in radially spaced relation to the pole and a reinforcing agent positioned between the sleeve assembly and pole. The improvement in the apparatus comprises, briefly, the sleeve assembly being secured in tight abutting relation to the pole at an upper end of the sleeve assembly, the sleeve assembly including a fill port below the upper end, and the reinforcing agent being a thermosetting plastic foam rigidly bonding the sleeve assembly to the pole over a length of the sleeve assembly below the upper end.

In another aspect, the apparatus of the present invention comprises a sleeve assembly having upper and lower sleeve sections which are joined together by a shear plane structure.

BRIEF DESCRIPTION OF THE DRAWING

FIG. 1 is a side elevation view in cross-section of a wooden utility pole having a reinforcing sleeve assembly constructed in accordance with the present invention mounted thereto, with the sleeve assembly before mounting shown in phantom.

FIG. 2 is a cross-sectional view taken substantially along the plane of line 2—2 in FIG. 1.

BEST MODE OF CARRYING OUT THE INVENTION

Figure 3:
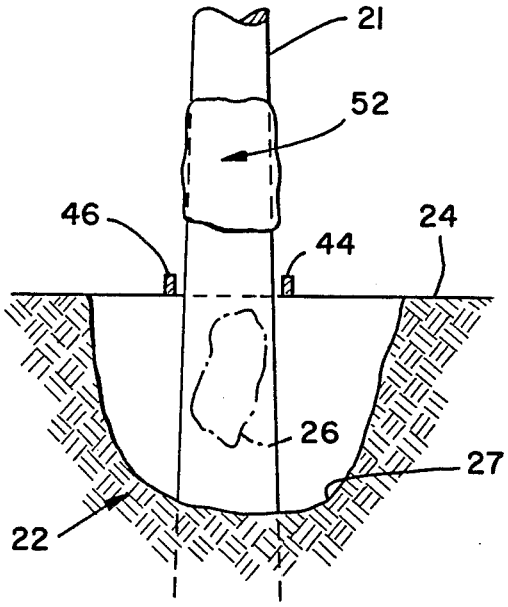
FIG. 3 is a side elevational view similar to FIG. 1, in reduced scale, prior to mounting of the sleeve assembly of the present invention around the pole.

In FIG. 1 a utility pole 21 is shown buried in the ground 22 with a lower end 23 of the pole extending a substantial distance below a nominal groundline 24. Decay and deterioration of the pole typically commence and spread from the interior of the pole toward the outside surfaces. Thus, the section or volume 26 shown in phantom represents an interior weakened or decayed volume within the pole. Obviously, it is preferable that attempts to repair or reinforce pole 21 be undertaken before decay and deterioration have completely spread across the diameter of the pole, although a pole which remains standing under such conditions can be repaired using the method and apparatus of the present invention. Decay section 26 typically extends from a position proximate groundline 24, namely between about two feet above and two feet below the ground line. In most instances, significant decay does not occur in pole 21 at a depth greater than about three feet below the groundline because the soil conditions will be anaerobic and will not support decay bacteria.

Many utility companies have a standard preventative inspection and maintenance procedure for periodically inspecting the condition of their poles and fumigating those wooden poles found to be decayed (e.g., every 10 to 15 years). Usually, such procedure calls for a laborer to dig an annular hole around the pole to a depth of about 1.0 to about 1.5 feet. The pole can then be injected fumigant to retard further decay. This preventative measure can be easily accomplished by relatively unskilled laborers using basic tools. A second crew will come out to the poles which are seriously decayed with special equipment to repair or replace the damaged poles.

It is an important feature of the method and apparatus of the present invention to provide a system which is sufficiently easy to use that it can be employed by relatively unskilled personnel in conjunction with routine pole inspection and maintenance. Accordingly, when a decayed pole is discovered during such an inspection procedure, or at any time, the pole inspection crew can simply enlarge the depth of the hole around the pole and use the method and apparatus of the present invention to reinforce the pole.

In order to provide access to the section of pole to be repaired or reinforced, the first step of the method of the present invention is to form an annular cavity 27 around pole 21. Cavity 27 is preferably formed to a depth of about three feet, or a depth at least slightly greater than the depth to which decay and deterioration of the pole might reasonably be expected for the local ground conditions. Thus, the inspection and fumigation hole can roughly be doubled in depth.

The next steps in the method of the present invention are to mount a pole reinforcing sleeve assembly, generally designated 31, around pole 21 in circumferentially spaced relation thereto, and fill the sleeve assembly with a reinforcing material. These steps are broadly known in the industry in connection with the repair of poles and pilings. The improved method of the present invention, however, greatly facilitates the manipulation of sleeve assembly 31 and results in a very strong and effective reinforcement over the length of decay section 26.

Figure 10:
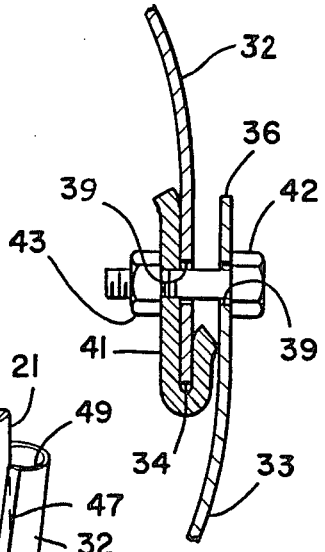
FIG. 10 is an enlarged, fragmentary, top cross section view of the pivotal joint between the bottom edges of sleeve sections.
Figure 8:
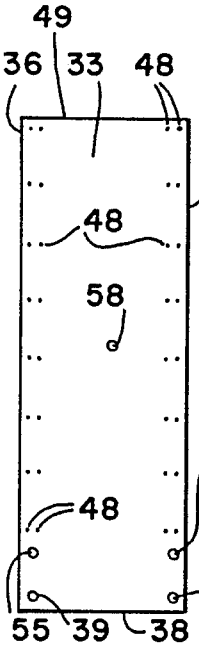
FIG. 8 is a side elevational view of the female half of the sleeve assembly of the present invention, with the sleeve being flattened out to illustrate the location of openings therein.
Figure 9:
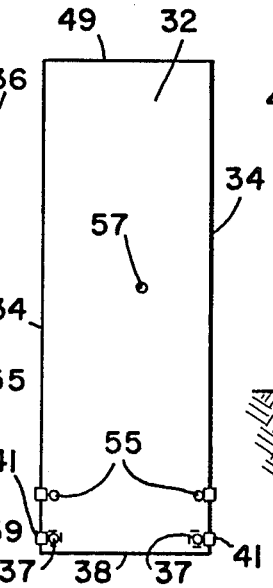
FIG. 9 is a side elevational view of the male half of the sleeve assembly corresponding to FIG. 8.

In the improved method, most of the manipulation of the sleeve assembly and filling of the same with a reinforcing material occurs at or above groundline 24. Thus, during the step of mounting the sleeve assembly to pole 21, sleeve assembly 31 is supported with a majority, and preferably all, of the sleeve assembly above groundline 24, while the sleeve assembly is loosely coupled around the pole and circumferentially secured at its lower end 38 against radial expansion. As best may be seen in FIGS. 4, 5, 8 and 9, sleeve assembly 31 is preferably formed by two semicircular sleeve sections 32 and 33. Male section 32 preferably has a diameter which is slightly less than the diameter of female section 33. The two sections can be mounted with their longitudinally extending side edges 34 and 36 in overlapped relation, as best may be seen in FIG. 10.

Since it is not practical to mount sleeve assembly 31 over the end of pole 21 when the pole is buried in the ground, sleeve assembly 31 is mounted to the pole from a side thereof. Employing two sleeve sections allows the sections to be positioned on each side of the pole and then coupled together by fasteners. As will be understood, a single flexible sleeve member (for example, a reinforced fiberglass sleeve) formed with a single side opening, or a sleeve assembly having more than two sections, also could be used.

It is preferable that male sleeve section 32 be provided with openings 37 proximate the corners between bottom edge 38 of section 32 and the side edges 34. Similar openings 39 are provided in female section 33. In order to reinforce the connection between sleeve sections and for convenience in assembly, it is preferable that a J-shaped clip 41 be carried by male sleeve section 32 so that a fastening bolt 42 and nut 43 (FIG. 10) can be used to secure the sections together in overlapped relation. During assembly of the shell sections, however, it is preferable that bolt 42 only be loosely threaded into nuts 43 so as to provide a pivotal connection between the two sections, as is more fully described below.

Figure 4:
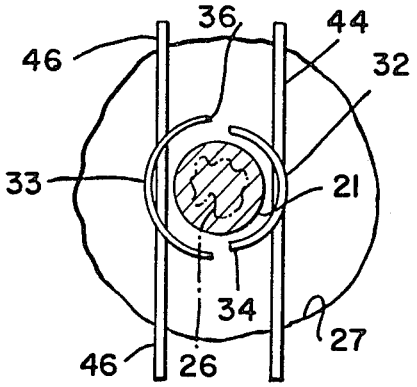
FIG. 4 is a top plan view corresponding to FIG. 3, with the sleeve assembly positioned around the pole.

Support of sections 32 and 33 during the process of bolting lower ends 38 together is preferably accomplished by placing support means, such as 2"×4" pieces of lumber 44 and 46 (FIG. 4), across cavity 27 proximate both sides of pole 21. Sleeve halves 32 and 33 then can be supported as shown in FIG. 4 in solid lines and in FIG. 1 in phantom lines while the sleeve sections are bolted together by bolts 42. Alignment of the holes 38 and 39 in the sleeve halves to receive bolts 42 can be effected by inserting a tool, such as a screwdriver, into alignment openings 55 in the sleeve sections.

Alternatively, sleeve sections 32 and 33 can be rotated by about 90 degrees and supported on members 44 and 46 during the bolting process. For convenience, the repair crew can also stand in cavity 27 during coupling of the lower edges of sections 32 and 33 together.

Figure 5:
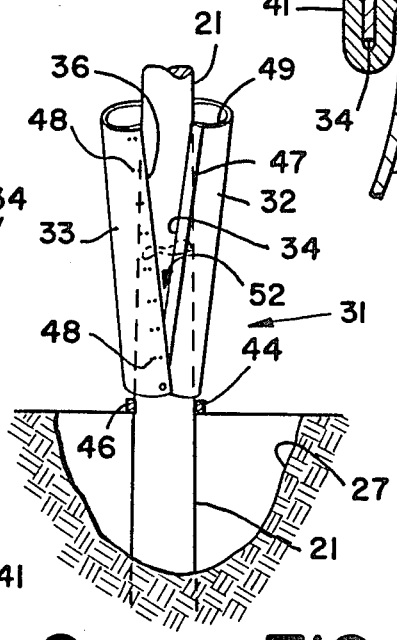
FIG. 5 is a side elevational view corresponding to FIG. 3 and illustrating assembly of the sleeve assembly around the pole.

Once the lower edges of the sleeve sections are bolted together and thereby constrained against radial expansion, the sleeves may be pivoted about bolts 42 by displacing the upper ends of the sleeves outwardly until they reach the position shown in FIG. 5. This exposes a margin or strip next to edges 34 of male section 32, which strip will lie underneath a corresponding strip next to edge 36 of female sleeve section 33. With edge 34 exposed over substantially its entire length, an adhesive agent can be applied along strip 47. After applying the adhesive to strips 47 at both edges 34, the two sleeve sections can be pivoted together at the upper ends to bring edges 34 and 36 into overlapping relation over the length of the sleeve assembly with adhesive 47 positioned between the overlapped side edges. At this point bolts 42 preferably are tightened to hold the assembled sections together as a stable unit.

To further secure the sleeve together as a unit against radial expansion with respect to the pole, a plurality of fasteners 45 (FIG. 2) are employed along the length of the overlapped edges of the sleeve sections. As may be seen in FIG. 8, female section 33 includes two rows of openings 48 proximate the longitudinal side edges 36 of the section. Self-tapping sheet metal screws 45 can be inserted through openings 48 and screwed into male sleeve section 32 by an electric-powered drill or screw-shooter along the area of adhesive strip 47. This fastening together of the sections will take place over at least the lower portion (about one-half) of the assembly while the assembly is supported by members 44 and 46.

In the preferred form of sleeve assembly 31, the sleeve sections are formed of sheet metal, preferably ¼ inch to 16 gauge A36 galvanized steel. This material will readily accept self-tapping sheet metal screws. It also is possible to employ reinforced fiberglass or other reinforced plastics as the sleeve material, particularly if the sleeve is provided as a one-piece sleeve having a longitudinally extending slit over the length of one side. The overlapped edges of such a fiberglass sleeve can be secured by fasteners and/or an adhesive.

As best may be seen in FIG. 1, wooden pole 21 typically will be tapered, with the large diameter end of the pole 23 being buried in ground 22. Many poles are formed from trees and have a correspondingly longitudinally tapered structure. In FIG. 1 the rate of taper has been exaggerated somewhat for the purpose of illustration.

The diameter of sleeve assembly 31 at the lower end 38 of the sleeve sections should be larger than the diameter of pole 26 at the bottom of cavity 27, taking into account the tapering of the pole. The diameter of upper end 49 can be smaller than the lower end since the pole will taper, but for ease of fabrication sections 32 and 33 of the sleeve assembly are usually cylindrical and formed with substantially the same diameter.

In the broadest aspect of the method of the present invention, the step of securing the upper portion of the sleeve assembly against radial expansion may take place while assembly 31 is supported at and above groundline 24 or after the step of lowering of the sleeve assembly into cavity 27. In the most preferred form of the present method, fasteners 45 will be used only in the lower portion of the sleeve assembly while it is above the ground. The assembly then will be lowered into the cavity and the upper portion will be secured against radial expansion. Securing the upper portion of the sleeve after lowering allows upper portion 51 of the sleeves to be radially contracted into tight abutting relationship with the tapered pole.

While contracting upper portion 51 of the sleeve assembly into abutting relationship with the pole has certain advantages, it is not required to achieve a high strength reinforcement of the pole over decayed section 26. Even if sleeve 31 is in spaced relation to pole 21 at upper portion or end 51, the strength of the sleeve material can be utilized to reinforce the pole if a bonding agent 56 is employed during the filling step which will rigidly bond the sleeve to the pole.

Thus, in the method and apparatus of the present invention sleeve assembly 31 is not used merely as a form or containment means for reinforcing agent 56, but it is bonded to the pole by the bonding agent so that the reinforcement is achieved by a combination of bonding agent 56 and sleeve 31.

After securing at least the lower portion of sleeve means 31 by fasteners 45 members 44 and 46 can be moved sufficiently to enable sleeve assembly 31 to be lowered down pole 21 until the sleeve extends over the length of the section of the pole to be reinforced, in this case, decay section 26. In the preferred form, sleeve assembly 31 is simply lowered until bottom edge 38 rests on the bottom of cavity 27.

Although not absolutely required, it is preferable that the next step in the method of the present invention is to refill cavity 27 with a filler material 67, most preferably the earth removed to form cavity 27. Obviously, if the material removed is not satisfactory for any reason, gravel or other fill can be used to refill the cavity.

Since it is most preferable to fill the space between pole 21 and sleeve 31 with a foaming bonding agent, refilling cavity 27 with material 67 provides radial support for shell 31 during foaming. For the preferred foaming bonding agent, however, the pressure generated during foaming is only about 2 to 5 pounds per square inch. Accordingly, sleeve 31 and the fasteners 45 used to secure the sleeve normally can withstand such an internal pressure without refilling cavity 27.

When a foaming bonding agent is employed, upper end 49 of the sleeve does not have to be sealed against pole 21, but if it is so sealed, the foam density and strength of bonding of the sleeve to the pole will be enhanced. Accordingly, it is preferable to contract an upper portion 51 radially into tight abutting engagement with pole 21. This contracting step can be accomplished before or after refilling cavity 27, but it is somewhat easier to effect if undertaken before hole 27 is refilled.

Moreover, it is further preferable that upper portion 51, be sealed to pole 21 so that foam will not expand out between the sleeve assembly and the pole at the upper end. Such sealing can be advantageously accomplished by applying an adhesive agent 52 to pole 21 in the area against which upper end section 51 will be contracted. This may best be seen in FIG. 3, and adhesive agent 52 can be most conveniently applied to pole 21 prior to mounting of the sleeve around the pole. A satisfactory adhesive for this purpose can be the filled epoxy foam described in detail below without the foaming agent.

Figure 6:
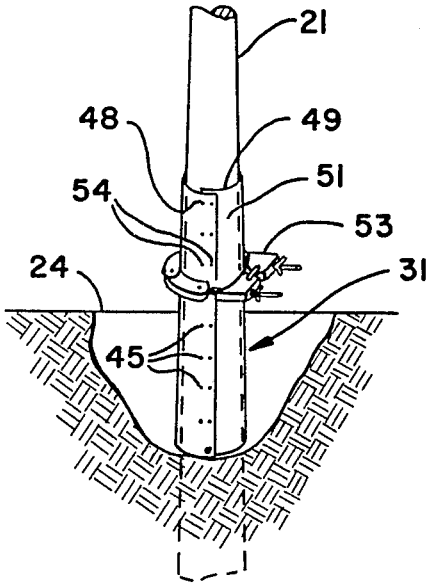
FIG. 6 is a side elevational view corresponding to FIG. 3 illustrating clamping of the sleeve assembly to the pole.
Figure 11:
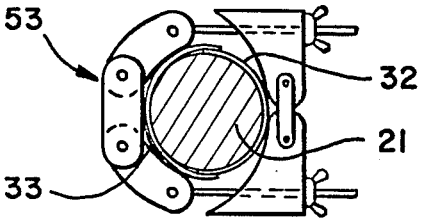
FIG. 11 is a top plan view in cross section of a clamping tool of FIG. 6 which may be used in clamping the upper end of the sleeve assembly to the pole.

One method of contracting the sleeve assembly into sealed relation with the pole is to use a clamping tool 53 (FIGS. 6 and 11). Tool 53 is formed to engage shell sections 32 and 33 at several locations or over a substantial portion of the periphery of the shell assembly so that the two shell halves can be overlapped in concentric relation with respect to each other to effect radial contraction down to the diameter of the pole. In FIG. 1 the difference in diameter between the shell assembly 31 and pole 21 is somewhat exaggerated as a result of the exaggeration in the taper of the pole, and normally the amount of contraction at section 51 at the upper end of the assembly will not be sufficiently great so as to require release of the sheet metal screws at the bottom of the sleeve assembly.

Clamp 53 can be positioned around sleeve assembly 31 at or one to two feet above groundline 24. A drill or screw-shooter can be used to set two screws through openings 54 proximate and immediately above the clamp, as well as in the rows of openings 48 below the clamp which were not secured prior to lowering of the sheave assembly into hole 27. Sheet metal screws can be progressively fastened through the pairs of holes upwardly along the section 51, with clamp 53 being moved and reclamped along section 51, if necessary, to insure a good seal between the sleeve sections and the pole. Typically, clamp 53 can be positioned about one to two feet above the groundline and repositioned one further time between the top and next to the top rows of holes to effect clamping.

Figure 7:
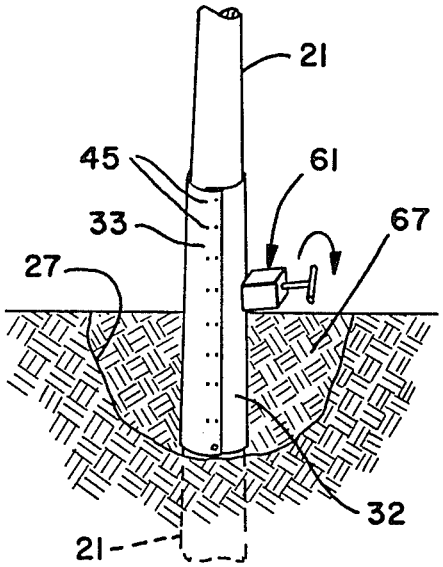
FIG. 7 is a side elevational view corresponding to FIG. 3 illustrating filling of the sleeve assembly with a bonding agent.
Figure 12:
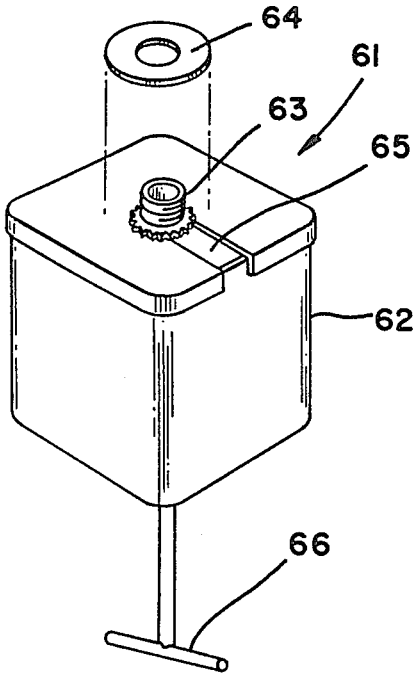
FIG. 12 is a top perspective view of a bonding agent injection assembly which may be used to fill the shell assembly with a bonding agent.

The final step in the insitu wooden pole reinforcement method of the present invention is comprised of filling the space below section 51 with a bonding agent which rigidly bonds the sleeve sections to the pole. Most preferably, this filling step is accomplished by injecting a thermosetting, foaming, plastic bonding agent 56 into the frusto-conical cavity between the sleeve assembly and the pole and allowing the foaming agent to foam until the space is filled. Fill ports 57 and 58 are preferably provided in each of the sleeve sections (FIGS. 1, 8 and 9) and a simple injector apparatus 61 (FIGS. 7 and 12) can be used to fill the sleeve assembly with bonding agent.

The method and apparatus of the present invention contemplate a bonding of sleeve assemblies 31 to the pole so that the strength of the sleeve material (metal, reinforced fiberglass or reinforced plastic) is utilized in reinforcing the pole.

In the most preferred form, the thermosetting, foaming, plastic bonding agent is a liquid epoxy foam system having a ceramic filler. More particularly, a foam marketed by Delta DPC, Inc. under the trademark EPICERAM and more fully described and set forth in U.S. Pat. No. 4,092,296 can be employed. The curing agent can be added to the resin, blowing agent, etc. in the field. Injector 61, for example, can house a collapsible resin container 65 inside housing shell 62. A separate container (not shown) with the curing agent can be used in the field with the curing agent being poured from the separate container through nozzle 63 into container 65. The components can be mixed in the field by using a drill having a paddle or mixing beater that is inserted into the container 65 through the nozzle to thoroughly mix the components.

Foam injector 61 is positioned against sleeve 31 with washer 64 used to seal around the fill port 57 or 58 (FIG. 7), which ports may be somewhat distorted from the contracting process. The injector handle 66 then can be rotated to advance a plunger (not shown) inside the injector, collapse container 65 and expel the mixed contents into the inside of the shell.

While it is preferable to use a foamed epoxy system, as compared for example to a foamed polyurethane system, other epoxy system and other bonding agents may be employed. Since wooden poles are susceptible to fire, and since burning polyurethane produces toxic products of combustion, epoxy systems have some advantages over polyurethane systems.

Figure 13:
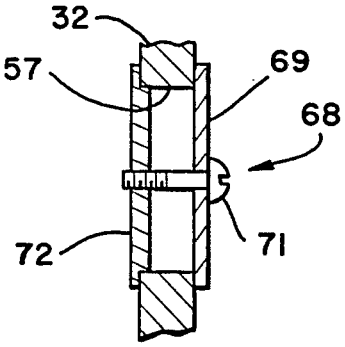
FIG. 13 is an enlarged, fragmentary, side elevational view of a closure assembly for the fill port in the sleeve assembly.

Once the epoxy has been injected into the sleeve assembly, closure means 68 in the form of a circular washer 69, fastener 71 and rectangular keeper element 72 can be mounted in each of the fill ports, as shown in FIG. 13.

An important aspect of the method and apparatus of the present invention is that sleeve assembly 31 is assembled around the pole, secured to the pole and filled all at positions proximate or above groundline 24. Thus, supporting sleeve assembly 31 on members 44 and 46 allows the bolt 42 to be tightened while above ground and the lower sheet metal screws 45 to be set while the assembly is above ground. After lowering, the sleeve is clamped at approximately the groundline, and sheet metal screws are set proximate the clamp and above. Fill ports 57 and 58 are located at about the groundline so that injection of foam can be accomplished after the hole or cavity has been refilled.

It is not necessary to close the bottom end of the sleeve since the ground will sufficiently confine the foam, which expands upwardly in the space between the sleeve and the pole. The sleeve assembly and method of the present invention do not require a cap above ground to close the mold since the sleeve is secured against the pole. The foam will expand with approximately a six to one expansion ratio to produce a foam having a density of about fifteen pounds per cubic foot, and the pressure inside the casing during foaming will be usually less than three psi. Sleeve assembly 31 preferably has a length of about six feet and can be made in several diameters to accommodate various diameter poles. A typical sheet metal sleeve assembly 31 will weigh less than 100 pounds.

In the preferred form, the epoxy foaming system includes iron oxide as a filler, which increases the overall compressive strength of the foam from about 200 psi to about 800 psi. The iron oxide also increases the stiffness of the epoxy once it has cured. The composite strength of the sleeve assembly is, however, enhanced by the fact that the skin strength of the foamed epoxy resin is greater than the compressive strength, and the assembly of the present invention has a substantial surface area. The foamed epoxy will tend to be most dense at the bottom, where the liquid is injected and starts to foam, and at the top, where the section is thin and the foam tends to compress by reason of being contained.

Figure 14:
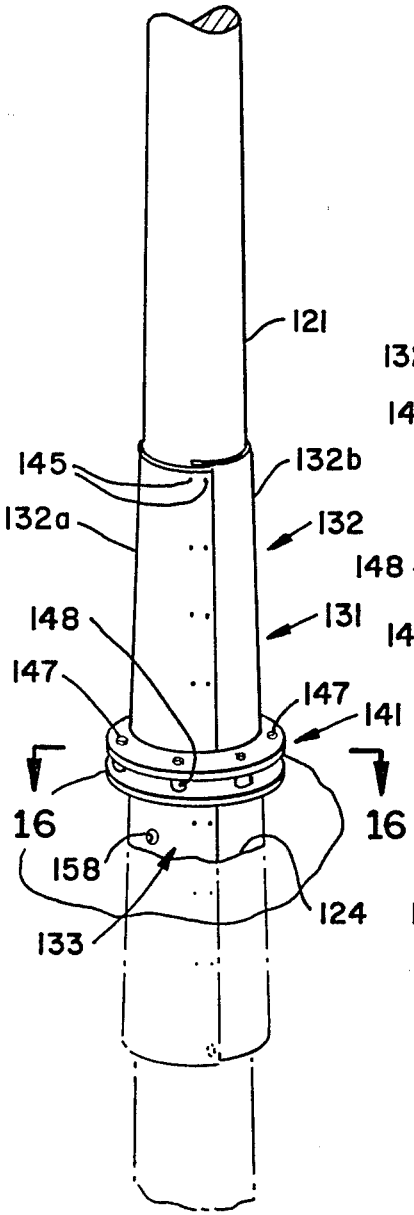
FIG. 14 is a side elevation view of an alternative embodiment of the sleeve assembly of the present invention including a shear plane.
Figure 15:
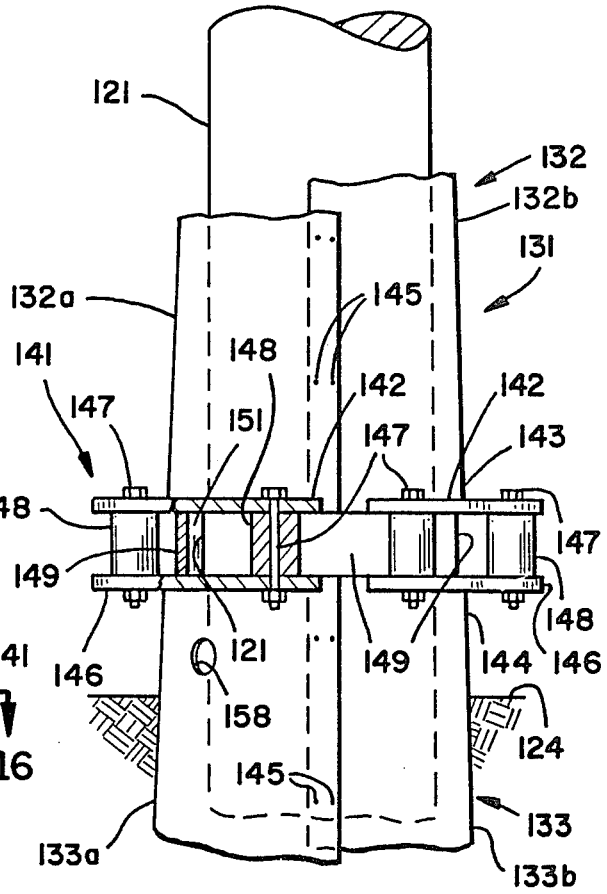
FIG. 15 is an enlarged, fragmentary, side elevation view of the shear plane portion of the sleeve assembly of FIG. 14.
Figure 16:
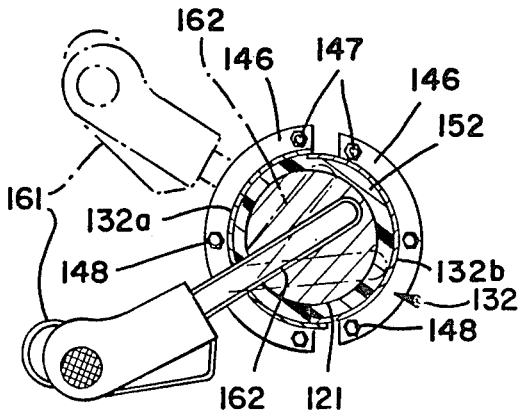
FIG. 16 is a top plan view, in cross section, taken substantially along the plane of line 16—16 in FIG. 14 and illustrating severing of the pole after installation of the sleeve assembly.

An alternative embodiment of the sleeve assembly of the present invention is shown in FIGS. 14, 15 and 16. Sleeve assembly 131 is shown mounted around utility pole 121. In order to provide enhanced safety, sleeve assembly 131 includes a shear plane structure or means 141 that joins an upper sleeve section 132 to a lower sleeve section 133. Shear plane means 141 extends transversely across the longitudinal axis of sleeve assembly 132 and is constructed to permit shearing of the sleeve assembly under a predetermined transverse load.

As shown in the drawing, shear plane means 141 is formed as a collar 142 on the lower end 143 of upper sleeve section 132. Attached to the upper end 144 of lower sleeve section 133 is a second collar 146. Juxtaposed collars 142 and 146 are joined together by shear bolts 147 which are surrounded by concentrically mounted spacer members 148.

In order to permit bonding of sleeve assembly 131 to pole 121 across shear plane structure 141, a frangible barrier wall 149 is provided which spans between the collars to contain foam in annular space 151 across shear plane 141.

As shown in the drawing, the upper sleeve section 132 is comprised of a female sleeve half 132*a* and a male sleeve half 132*b*. Similarly, the lower sleeve section 133 is comprised of a female sleeve half 133*a* and a male sleeve half 133*b*. Each of the halves are provided with collars 142 and 146, which are also split collars, as best may be seen in FIG. 16. The assembly can be mounted to pole 121 as described in connection with assembly 31 of FIGS. 1–13. Shear bolts 147 will couple the upper and lower sleeve sections together so that the sleeve halves can be mounted to the pole in the same manner as halves 32 and 33. Thus, a plurality of fasteners 145 can be used to couple the sleeve halves together against radial expansion.

As above described, after mounting sleeve assembly 131 to pole 121, the space between the sleeve assembly and pole is filled with a bonding agent preferably a filled epoxy foam, 152. The foam can be injected through fill port 158 positioned proximate and preferably above groundline 124. Sleeve assembly 131 is also preferably mounted with the shear plane means 141 at or above groundline 124.

After foaming the sleeve assembly and bonding the same to the pole, it is a further feature of the present invention that pole 121 and bonding agent 152 at shear plane means 141 be severed transversely across the sleeve assembly. This may advantageously be accomplished by means of a chain saw 161 having a blade 162 which can be inserted between shear bolts 147 and pivoted as shown in FIG. 16 to cut the pole and foam at the shear plane. Chain saw 161 can be inserted at various locations circumferentially about the pole so that virtually all of the pole and foam and foaming barrier 149 will be severed. Once the process is complete, the pole will be supported solely by shear bolts 147 so that a predetermined known lateral force or impact will shear the pole and sleeve assembly at plane 141.

This structure enables the utility companies to repair a below ground decayed pole and at the same time install a shear plane in a wooden pole which greatly enhances the safety of such poles when located next to a highway.

Sleeve assemblies 131 can be employed to provide a shear plane in wooden utility poles, even if the pole has not experienced decay or deterioration which would require repair. It is also possible to use the method and sleeve assembly of the present invention on a wooden pole as it is originally installed to provide a pole having a shear plane for controlled shearing of the pole in the event of an automobile impact or the like. The number and strength of the shear bolts joining collars 42 and 46 can be selected to insure sufficient strength of the pole under normal loading conditions and yet a shear force at plane 141 which would be substantially below the somewhat unpredictable force normally required to shear a wooden utility pole.

What is claimed is:

1. In a method for insitu reinforcement of a section of a pole at a position below the groundline while said pole is supported in the ground, including the steps of, forming an annular cavity in the ground around said pole to a depth exposing said section, mounting elongated sleeve means around said pole from a side of said pole with said sleeve means positioned in radially spaced relation to said pole to define a space between said pole and said sleeve means, and filling said space with a reinforcing material, wherein the improvement in said method comprises:

during said mounting step, supporting said sleeve means with the majority of the length thereof above said groundline while loosely coupling said sleeve means around said pole and securing a lower end portion said sleeve means against radial expansion;

after said supporting step, lowering said sleeve means down said pole until said sleeve means extends over a length of said section to be reinforced;

before said filling step, securing an upper portion of said sleeve means against radial expansion; and during said filling step, filling said space between said pole and said sleeve means with a foaming bonding agent selected to rigidly bond said sleeve means to said pole and allowing said bonding agent to foam and bind said sleeve means to said pole to reinforce said pole over said section with the combined strength of said sleeve means and the foamed bonding agent.

2. The method as defined in claim 1, and after said lowering step, contracting said upper portion of said sleeve means into tight abutting relation with said pole.

3. The method as defined in claim 2, and applying an adhesive agent to said pole prior to said lowering step, said adhesive being applied at a position against which said upper portion is to be secured after said lowering step, said contracting step is accomplished by radially clamping said upper portion against said adhesive agent and said pole, and said circumferential securing of said upper portion against radial expansion is accomplished after said contracting step.

4. The method as defined in claim 1 wherein, said filling step is accomplished by placing a liquid epoxy, closed cell, foam system in said space.

5. The method as defined in claim 1 wherein, said mounting step is accomplished by mounting a sleeve means having a lower end with a diameter greater than said pole at the bottom of said cavity, a diameter at an upper end about equal to the diameter of said pole proximate and above said groundline, and a length greater than the depth of said cavity; and said lowering step is accomplished by lowering said sleeve mean until said lower end is supported by the ground at the bottom of said cavity and said upper end extends above said groundline.

6. The method as defined in claim 1 wherein, said supporting step is accomplished by positioning members having a length sufficient to span across said cavity proximate to both sides of said pole and supporting said lower end of said sleeve means on said members.

7. The method as defined in claim 1 wherein, said supporting step is accomplished by placing support means across said cavity proximate said pole and supporting a lower end of said sleeve means on said support means.

8. The method as defined in claim 7, and the step of:

prior to said lowering step, moving said support means sufficiently to permit lowering of said sleeve means along said pole.

9. The method as defined in claim 1 wherein, said sleeve means is provided as at least two sleeve sections dimensioned to be assembled with longitudinally extending side edges mounted in overlapping abutting relation; and during said supporting step, pivotally securing said sections together proximate lower ends thereof, pivoting said sections apart at the upper ends thereof, applying an adhesive agent to said side edges, pivoting said sections together at said upper ends, and securing said edges together in overlapped relation with said adhesive agent therebetween.

10. The method as defined in claim 1 wherein, prior to said filling step, refilling said annular cavity with filler material.

11. The method as defined in claim 1, and during said mounting step, mounting sleeve means having a structure providing a horizontally extending shear plane across said sleeve means.

12. The method as defined in claim 1, and during said mounting step, mounting sleeve means having means defining a horizontal shear plane extending across said sleeve means and having linking means of known shear strength extending longitudinally across said shear plane and coupling said sleeve means together across said shear plane, and after said filling step, severing said foamed bonding agent and said pole at said shear plane while supporting said pole by said linking means.

13. The method as defined in claim 13 wherein, said severing step is accomplished by sawing said foamed bonding agent and said pole from a side of said sleeve means and said pole.

14. The method as defined in claim 13 wherein, said sawing step is accomplished by inserting a chain saw between said linking means.

15. The method as defined in claim 12 wherein, said mounting step is accomplished by mounting sleeve means having an upper sleeve portion and a lower sleeve portion, and by providing said means defining said shear plane by juxtaposed collars on said supper sleeve portion and said lower sleeve portion, and further by providing said linking means by a plurality of shear bolts circumferentially spaced about said collars.

16. Apparatus for the insitu reinforcement of a wooden utility pole while supported in the ground including, a sleeve assembly having a longitudinal axis and mounted in radially spaced relation to said pole and extending axially from a position below the groundline to a position above the groundline, and a reinforcing agent positioned between said sleeve assembly and said pole, wherein the improvement in said apparatus comprises:

an upper portion of said sleeve assembly including male and female sleeve halves being secured above the ground in tight abutting relation to said pole; a lower portion of said sleeve assembly surrounding said pole and extending into said ground, said sleeve assembly lower portion including male and female sleeve halves and including a fill port in a side thereof positioned below said upper portion, and said reinforcing agent being a thermosetting, plastic foam rigidly bonding said sleeve assembly to said pole over a length of said sleeve assembly lower portion and below said upper portion, said sleeve assembly flaring outwardly from the upper portion to the lower portion and further including shear plane means between said upper and lower portions and extending transversely of said longitudinal axis across said sleeve assembly to enable shearing of said sleeve assembly under a predetermined force.

* * * * *